US007175020B2

(12) United States Patent
Sutherland et al.

(10) Patent No.: US 7,175,020 B2
(45) Date of Patent: Feb. 13, 2007

(54) FLAT PRIMARY AND SECONDARY LOCKING SYSTEM

(75) Inventors: Robert L. Sutherland, Kennesaw, GA (US); Kevin T. May, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 192 days.

(21) Appl. No.: 10/801,523

(22) Filed: Mar. 15, 2004

(65) Prior Publication Data

US 2005/0199514 A1 Sep. 15, 2005

(51) Int. Cl.
*B65D 75/00* (2006.01)

(52) U.S. Cl. ..... 206/139; 206/173; 229/198.2

(58) Field of Classification Search ..... 206/139, 206/170, 171, 173–175, 193, 194, 197, 200, 206/427, 434; 229/198.2, 103.2
See application file for complete search history.

(56) References Cited

U.S. PATENT DOCUMENTS

| | | | | | |
|---|---|---|---|---|---|
| 3,669,342 | A | | 6/1972 | Funkhouser | |
| 3,680,765 | A | * | 8/1972 | Harrelson | 206/145 |
| 4,526,316 | A | | 7/1985 | Sutherland | |
| 4,708,284 | A | * | 11/1987 | Sutherland et al. | 229/198.2 |
| 4,925,019 | A | * | 5/1990 | Ganz et al. | 206/145 |
| 5,131,588 | A | | 7/1992 | Oliff | |
| 5,180,100 | A | | 1/1993 | Shimizu | |
| 5,297,673 | A | * | 3/1994 | Sutherland | 206/147 |
| 5,351,878 | A | | 10/1994 | Cooper | |
| 5,472,138 | A | | 12/1995 | Ingram | |
| 5,485,915 | A | * | 1/1996 | Harris | 206/147 |
| 5,549,197 | A | * | 8/1996 | Sutherland | 206/158 |
| 5,609,251 | A | * | 3/1997 | Harris | 206/434 |
| 5,855,318 | A | | 1/1999 | Baxter | |
| 5,931,300 | A | * | 8/1999 | Sutherland | 206/427 |
| 5,941,389 | A | * | 8/1999 | Gomes | 206/427 |
| 5,941,453 | A | * | 8/1999 | Oliff | 229/158 |
| 5,975,286 | A | | 11/1999 | Oliff | |
| 5,975,287 | A | * | 11/1999 | Negelen | 206/168 |
| 6,158,586 | A | * | 12/2000 | Muller | 206/427 |
| 6,289,651 | B1 | | 9/2001 | Le Bras | |
| 6,315,123 | B1 | | 11/2001 | Ikeda | |

(Continued)

*Primary Examiner*—Mickey Yu
*Assistant Examiner*—Steven Pollicoff
(74) *Attorney, Agent, or Firm*—Womble Carlyle Sandridge & Rice, PLLC

(57) ABSTRACT

A new type of secondary locking system for article carriers consisting of at least one secondary male lock with two shoulders that is attached by a neck to the edge of a outer flap on the carrier for use with a primary locking system. An inner flap has a secondary female opening for each secondary male lock. The secondary female opening is formed by a secondary cut line and fold line with the center of the fold line projecting towards the edge of the flap while of the center of the secondary cut line projects away from the edge of the flap to guide the secondary male lock into a flat position against the inside of the inner flap. The shoulders on the secondary male lock are engaged against locking ledges along the extensions of the secondary cut line. A pair of slits may be formed at the end of the fold lines that project inwardly to allow the secondary male lock to slide into a flat position. This locking system is especially useful in wrapping containers that have a flat bottom that would interfere with conventional locking systems.

39 Claims, 9 Drawing Sheets

U.S. PATENT DOCUMENTS 6,877,600 B2 * 4/2005 Sutherland ..... 206/140
2002/0112973 A1 8/2002 Sutherland
2004/0000494 A1 1/2004 Sutherland
2004/0245326 A1 12/2004 Ikeda
2005/0001020 A1 1/2005 Garnier

* cited by examiner

FLAT PRIMARY AND SECONDARY LOCKING SYSTEM

BACKGROUND OF THE INVENTION

1. Field of the Invention

The present invention relates generally to a carrier for carrying containers or other types of articles. This carton has a flat primary and secondary locking system for interlocking the bottom flaps. The primary and secondary locks interlock in a flat plane and remain locked in spite of the containers having a flat bottom. This carrier may be used to carry cans and bottles or containers of various shapes and sizes.

2. Background of the Invention

Wrap-around carriers for carrying bottles or cans may be secured by locks. These carriers typically have a primary and secondary locking system which interlocks two bottom flaps together. Containers that have flat bottoms frequently interfere with these locking systems as the secondary locks in particular usually need to project into the carton and do not lie in a flat plane. It would be desirable to have a secondary locking system in which the locks lie in a flat plane and securely hold the carrier together.

SUMMARY OF THE INVENTION

Briefly described, the present invention relates to a wrap-around carrier which is held together by a primary and secondary locking system. This carrier has a bottom panel formed from the inner flap and an overlapping outer flap which are interlocked. Each primary lock has a primary male lock which is formed by a slit cut in the outer flap and a primary lock ledge formed in a primary female opening in the inner flap. The primary male lock is engaged with the primary lock ledge with the primary locking system lying flat against the bottom panel of the carrier.

The secondary locking system has at least one secondary male lock with two shoulders that is connected by a neck to the edge of the outer flap. A secondary female opening is formed in the inner flap for each secondary male lock. This secondary female opening is formed further from the edge of the inner flap than the primary female opening. Each secondary female opening is formed by a cut line and fold line with the fold line being closer to the edge of the inner flap than the cut line. The fold line has a center that is closer to the edge of the inner flap than the ends of the fold line. Preferably, the fold line is arcuate in shape. The cut line for forming this secondary female opening has a center that is further from the edge of the inner flap than the ends of the cut line. Preferably, this secondary cut line is V shaped. This secondary cut line extends beyond each end of the fold line to form a secondary locking ledge along the side of the extension cut remote from the edge of the inner flap with a shoulder of a secondary male lock locked against the locking ledge. The secondary cut line meets, or nearly meets, the fold line at each of its ends. A female flap is formed in this secondary female opening. Placing the fold line and cut line so that the distance between them is wider at the center provides resistance against the female flap folding when the secondary male lock is inserted into the female opening that it assists in guiding the secondary male lock into a position flat against the inside of the inner flap. The center of the cut line being further removed from the edge of the inner flap also helps guide the secondary male lock into a flat position against the inside of the inner flap. A couple of slits may be placed near where each end of the fold line meets the secondary cut line, with the slits extending away from the edge of the inner flap. These slits assist in letting the secondary male lock slide flat against the inner flap. The distance between these slits for each secondary female opening is preferably greater than the distance between the edges of the neck of the secondary male lock to allow the neck to fit between the slits. This helps insure that the locking ledge is not pushed out of the plane of the inner flap which could allow a shoulder to pass through the extension cut and unlock the secondary male lock. A slight turn can be placed in the end of the cut line forming the extension to prevent this cut line from tearing under the stress of the secondary lock being locked.

The carrier of this invention can be used to carry a single row or multiple rows of containers. This carrier can be used with both bottles and cans and also with plastic tubs.

The fact that the secondary locking system lies flat against the inside of the inner bottom flap allows this lock system to be used with containers, such as plastic tubs, that have a flat bottom. The primary locking system lies flat against the bottom inner flap as well.

The carrier of this invention may have open ends. Retaining flaps can be placed on the top or bottom of the ends of this carrier to prevent the bottles or cans from falling out. The locking system of this invention can be used with carriers that have other means of preventing the cans or bottles from falling out of the ends of the carrier or with carriers that are fully enclosed.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

The present invention is primary for use with cans, bottles or tubs used to contain food or drink. The present invention is especially useful in wrapping containers that have a flat bottom.

Figure 1A:
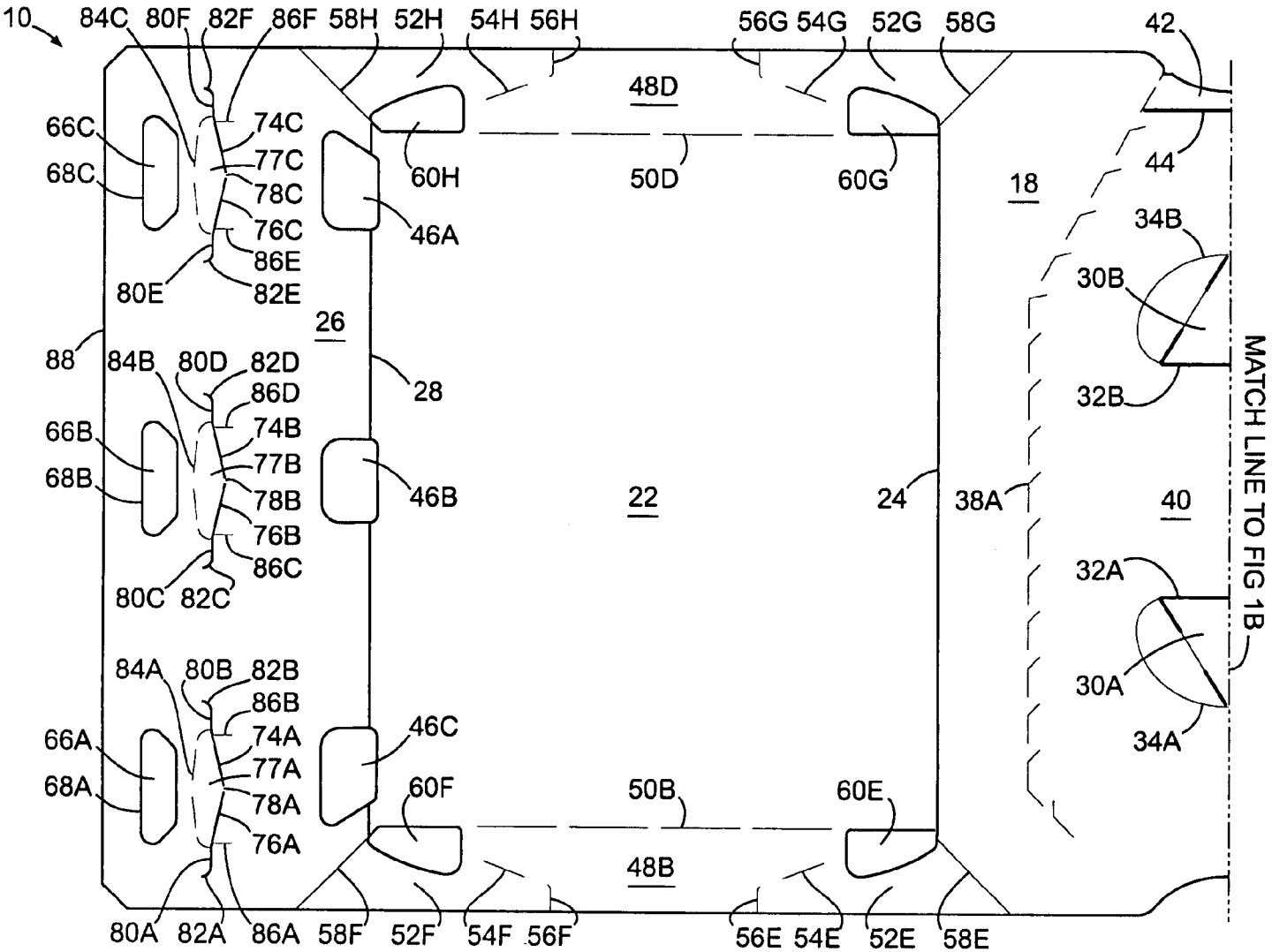
FIG. 1 is a plan view of a carrier blank for forming a carrier to contain six cans of one embodiment of this invention.
Figure 1B:
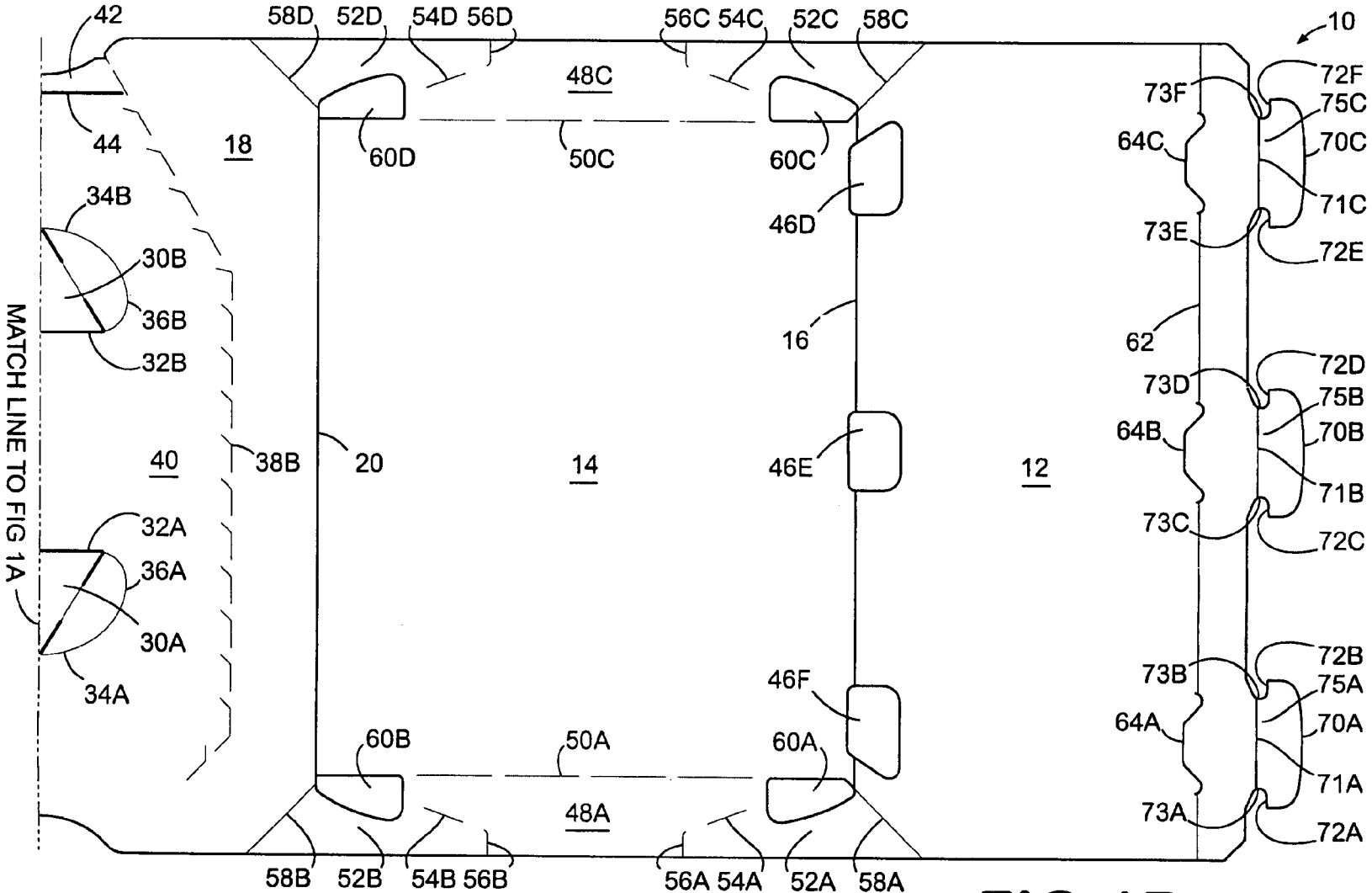

As illustrated in FIG. 1, the blank 10 for forming one embodiment of this invention is formed from a foldable sheet of material, such as paperboard. The blank 10 for forming the carrier of this invention has an outer flap 12 that is attached to a side panel 14 by fold line 16 and in turn attached to top panel 18 by fold line 20. Top panel 18 is attached to opposite side panel 22 by fold line 24 and in turn attached to inner flap 26 by fold line 28.

Finger flaps 30A–B may be provided by cut lines 36A–B and fold lines 32A–B, which when opened provide finger apertures 36A–B for carrying the carrier. A dispenser flap 40 is formed in the top panel 18 by tear lines 38A–B. A starting tab 42 which is attached to dispensing flap 40 by fold line 44 may be provided to start the removal of the dispenser flap 40 which will provide a dispenser opening for removing the cans from the carrier.

Heel apertures 46A–F in which fingers of the packaging machine may be inserted to tighten the carrier around a group of cans may be provided. These heel apertures 46A–F also assist in holding the cans in the proper position. The tops of the cans may be held within the carrier by the provision of tuck-in flaps 48A–D which are attached to respective side panel 14 or 22 by fold line 50A–D, and corner gusset panels 52A–H. These tuck-in flaps 48A–D and corner gusset panels 52A–H are constructed by providing fold lines 54A–H, 56A–H and 58A–H. Apertures 60A–H may be provided to assist in folding the tuck-in flaps 48A–D and corner gusset panels 52A–H into position for holding cans in the carrier.

This carrier is held together by a combination of a primary locking system and a secondary back-up locking system. Primary male locks 64A–C are formed along fold line 62 for engaging and locking with the respective primary lock ledge 68A–C formed in primary female aperture 66A–C.

Figure 5A:
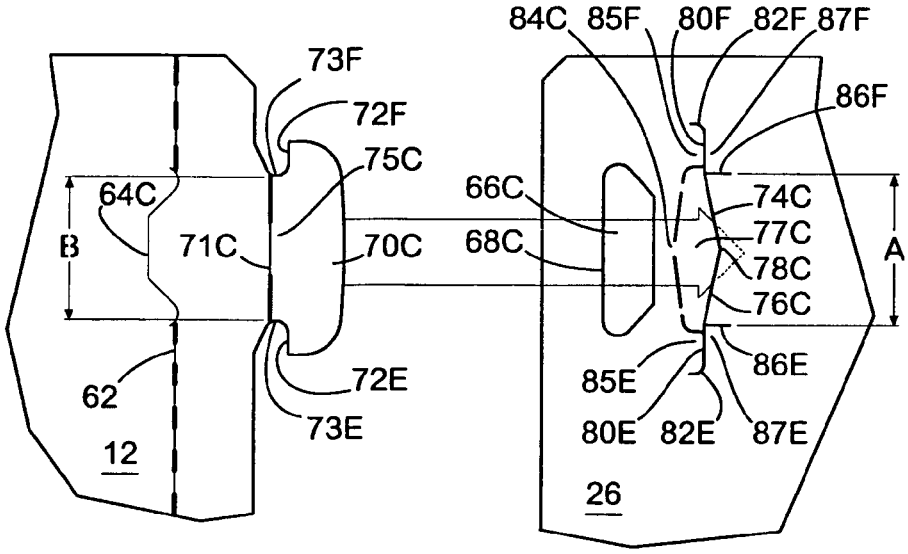
FIG. 5A is a fragmentary view of a primary and secondary lock in the process of being locked.

The secondary male locks 70A–E are formed as an extension of outer flap 12 to which they are attached by necks 75A–C. In the illustrated embodiment, the secondary male locks 70A–E each include a fold line 71A–C. Secondary female openings 74A–C are formed in inner flap 26 by secondary cut lines 76A–C and fold lines 84A–C which are generally parallel to the terminal edge 88 of the inner flap 26. Extension cuts 80A–F of secondary cut line 76A–E are provided to allow the shoulders 72A–F of the secondary male locks 70A–C to pass through the inner flap 26 in the locking operation into the locked position against locking ledges which are illustrated in FIG. 5A by numerals 87E–F. These locking ledges 87A–F are adjacent the extension cuts 80A–F on the side of the cut remote from the terminal edge 88 of inner flap 26. Terminal cuts 82A–F may be provided at the end of each extension cut 80A–F to prevent the cut from tearing into the inner flap 26 under the stress imposed by the shoulders 72A–E of the secondary male locks 70A–C when they are inserted through the extension cuts 80A–F during locking.

Figure 2:
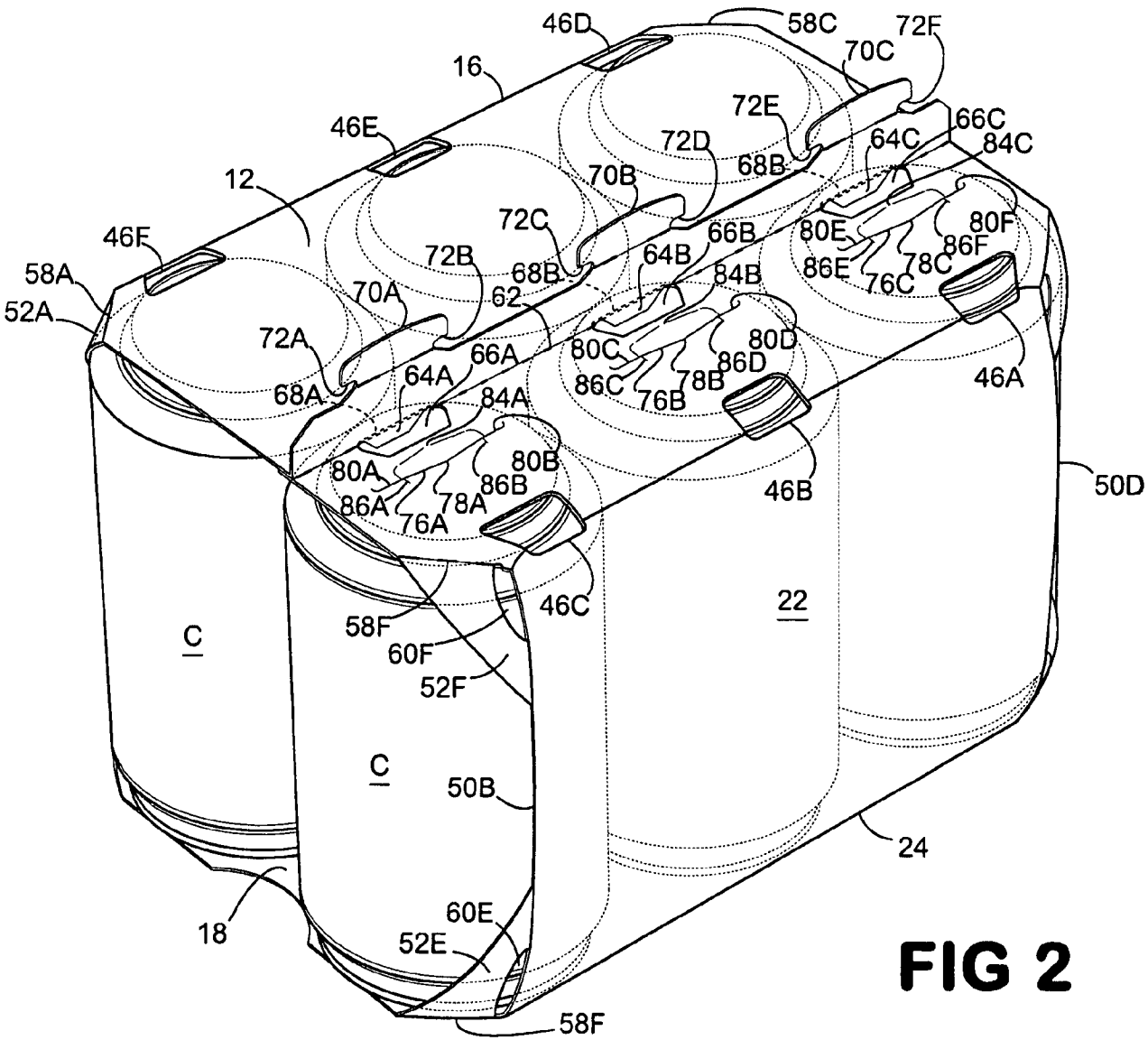
FIG. 2 is a perspective view of a carrier made from the blank of FIG. 1 and wrapped around six cans with the carrier being shown in the inverted position which shows the secondary male locks lined up in preparation for locking.

The blank 10 is wrapped around a group of six cans in two rows and secured by locking the primary and secondary locks together. The tuck-in flaps 48A–D are folded inwardly and held in position by the cans adjacent to the ends of the carton and the side panels 14 and 22. These tuck-in flaps 48A–D hold the corner gusset panels 52A–H in position adjacent a corner of a can as illustrated in FIG. 2, which shows the carrier in the inverted position. The outer flap 12 is overlapped over the inner flap 26 and the primary male locks 64A–C are inserted into the primary female apertures 66A–C and locked against the primary lock ledges 68A–C as illustrated in FIGS. 2–4.

Figure 3:
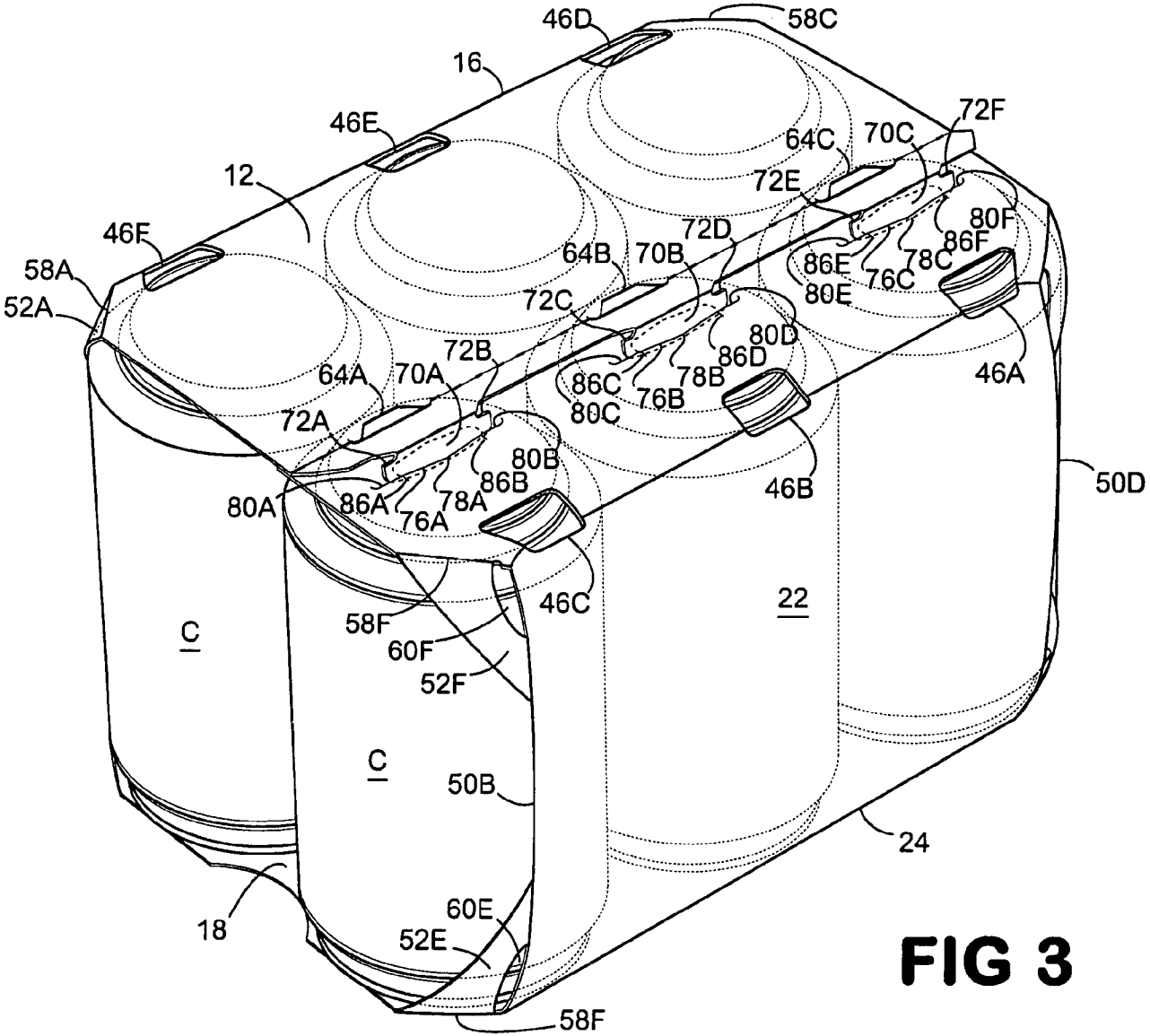
FIG. 3 is a perspective view of the carrier of FIG. 2 with a secondary male locks having being inserted part way into the secondary female openings.
Figure 4:
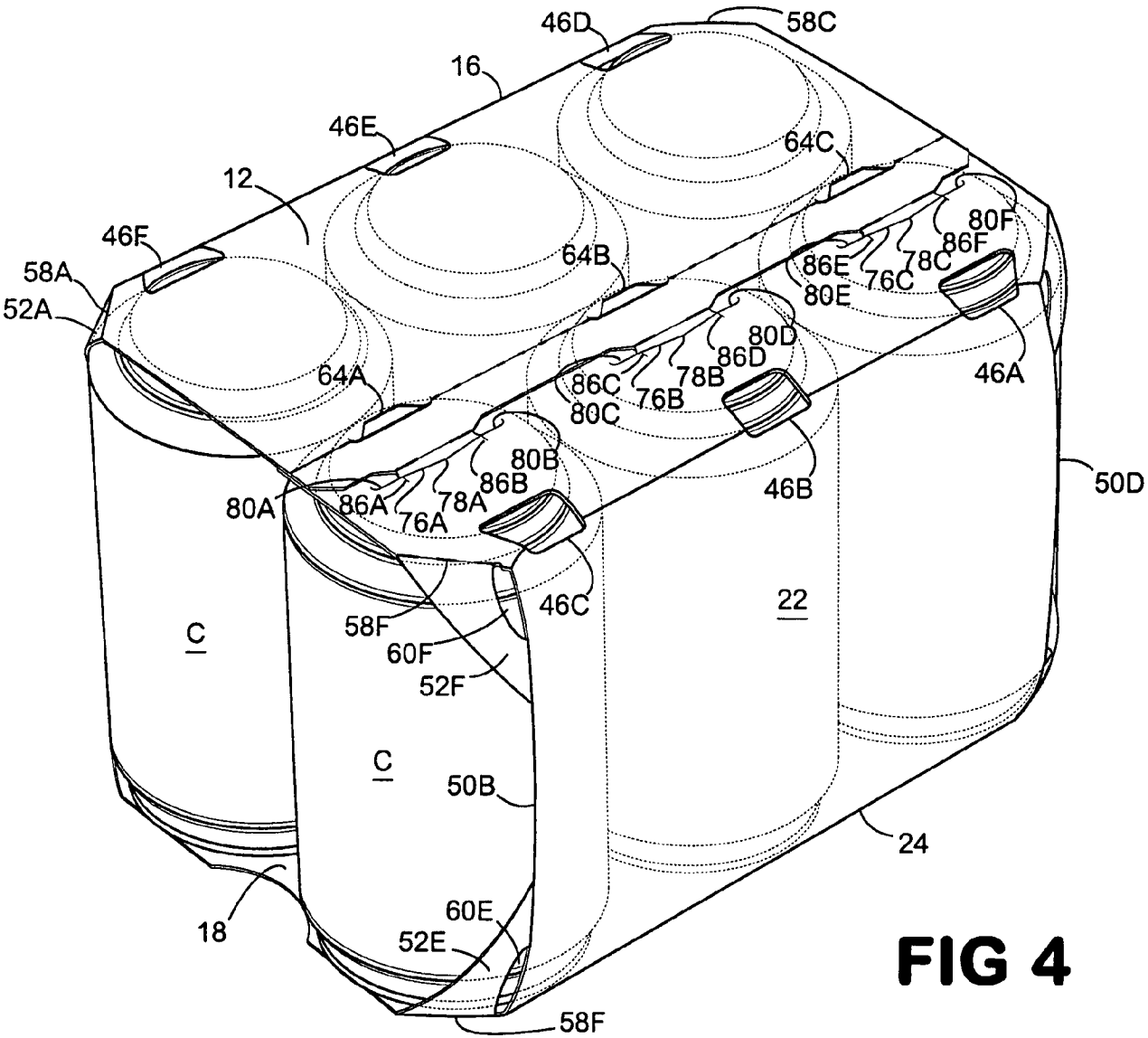
FIG. 4 is a perspective view of the carrier of FIG. 3 in which the secondary male locks have been inserted into the secondary female openings and locked.

The secondary male locks 70A–C are inserted into the secondary female openings 74A–C as illustrated in FIG. 3 which also shows the carrier in the inverted position to illustrate the locking of the carrier. The packaging machine continues the locking operation by pushing the secondary male locks 70A–C fully into the secondary female openings 74A–C as shown in FIG. 4. The secondary male lock 70A–C is guided into a flat position against the inside of the inner flap 26 by the configuration of the secondary cut line 76A–C which is further from the terminal edge 88 of the inner flap 26 at the center than the ends of the secondary cut line 76A–C. This secondary cut line 76A–C preferably is V shaped with an apex which aids in guiding the secondary male lock 70A–C into the flat position. The center of the fold line 84A–C is closer to the terminal edge 88 of the inner flap 26 than the ends of the fold lines. The configuration of the secondary cut lines 76A–C and fold lines 84A–C results in the formation of a secondary female flap 77A–C that is wider at the center than at the ends. This provides resistance against the secondary female flap being pushed inwardly which aids in ensuring that the secondary male locks 70A–C lie in a flat plane. The secondary female flaps 77A–C also stay in a flat plane because of their resistance against being pushed inwardly. Each fold line 84A–C turns at each end until it meets or nearly meets a secondary cut line 76A–C. The preferred configuration for the secondary female opening 74A–C is for the fold line 84A–C to be arcuate in shape and for the secondary cut line 76A–C to be V shaped and have an apex 78A–C.

Figure 5:
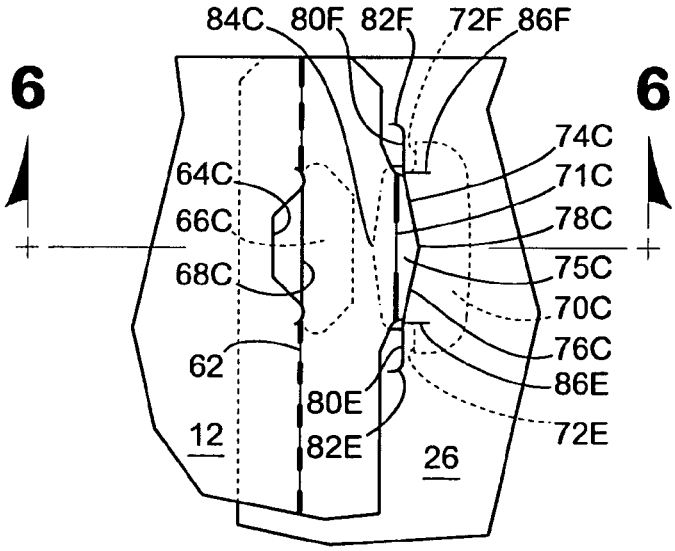
FIG. 5 is a fragmentary view of a primary and secondary lock that have been engaged.

The manner in which the secondary male lock 70C enters the secondary female opening 74C is illustrated in FIG. 5A. The completion of the inner locking of the primary male lock 64C against the primary lock ledge 68C is illustrated in FIG. 5.

As shown in FIG. 5A the secondary male lock 70C is lined up to be inserted into secondary female opening 74C with the shoulders 72E–F lined up to be inserted through extension cuts 80E–F. In order to have a secondary locking system that is flat as possible so it is not hampered by the flap bottoms of the containers, it is necessary that all parts of inner flap 26 and outer flap 12 be in the same plane or only slightly disposed from the plane.

This feat is aided with the secondary locking system of this invention by the introduction of two additional features which also help insure that the secondary locks remain securely locked. Slits 86A–F may be provided to permit the slight displacement outwardly of the portion of the inner flap 26 between the slits as shown by slits 86E and 86F adjacent to secondary cut line 76C in FIGS. 5 and 5A. These slits 86A–F extend from the secondary cut line 76A–E away from the terminal edge 88. Each slit is located near an end of fold line 84A–E. This slight displacement between slits 86E and 86F is necessary to allow the neck 75C of the secondary male lock 70C to be located in the secondary female opening 74C. These slits 86A–F allow the locking ledges 87E–F to return to the plane of the inner flap 26 after the shoulders 72E–F have passed through extension cuts 80E–F and the secondary male lock is in the locked position as shown in FIG. 5A. As shown in FIGS. 5A and 5, if the locking ledges 87E–F were displaced from the plane of inner flap 26 and therefore in a different plane than locking lands 85E–F on the other side of extension cuts 80E–F then the shoulders 72E–F could pass back through extension cuts 80E–F and the secondary male lock 70C would become unlocked. In order for the locking ledge 87E–F to return to the same plane as locking lands 85E–F, the distance B between the edges 73E–F of the neck 75C should be less than the distance A between slits 86E–F as shown in FIG. 5A.

Figure 6:
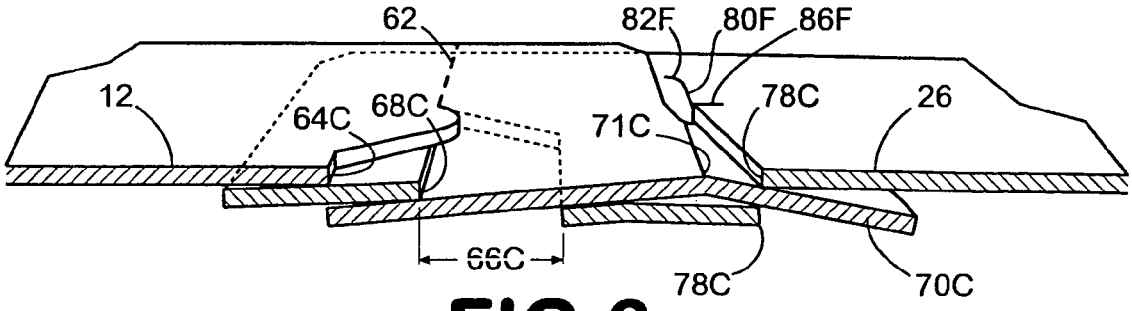
FIG. 6 is a perspective cross-section of a bottom panel of FIG. 5 taken across line 6—6 showing how the primary and secondary locks lie basically flat.

Both the primary male lock 64C and secondary male lock 70C are shown in a substantially flap position in FIG. 6. The fact that the containers in the carrier have flat bottoms does not interfere with the primary and secondary locking arrangement of this invention.

This carrier loaded with cans can be carried when finger flaps 30A–B have been pushed inwardly. This carrier can be opened by tearing tear lines 38A–B by grasping the starting tab 42 and pulling the dispenser flap 40 open.

It should be realized that many other types of can packs can utilize the primary and secondary locking arrangement of this invention. The primary and secondary locking system of this invention can also be used to wrap various types of articles and other types of containers such as tubs and bottles. This locking system can be used for locking wrap-around carriers carrying containers in one, two, or more rows.

Figure 7A:
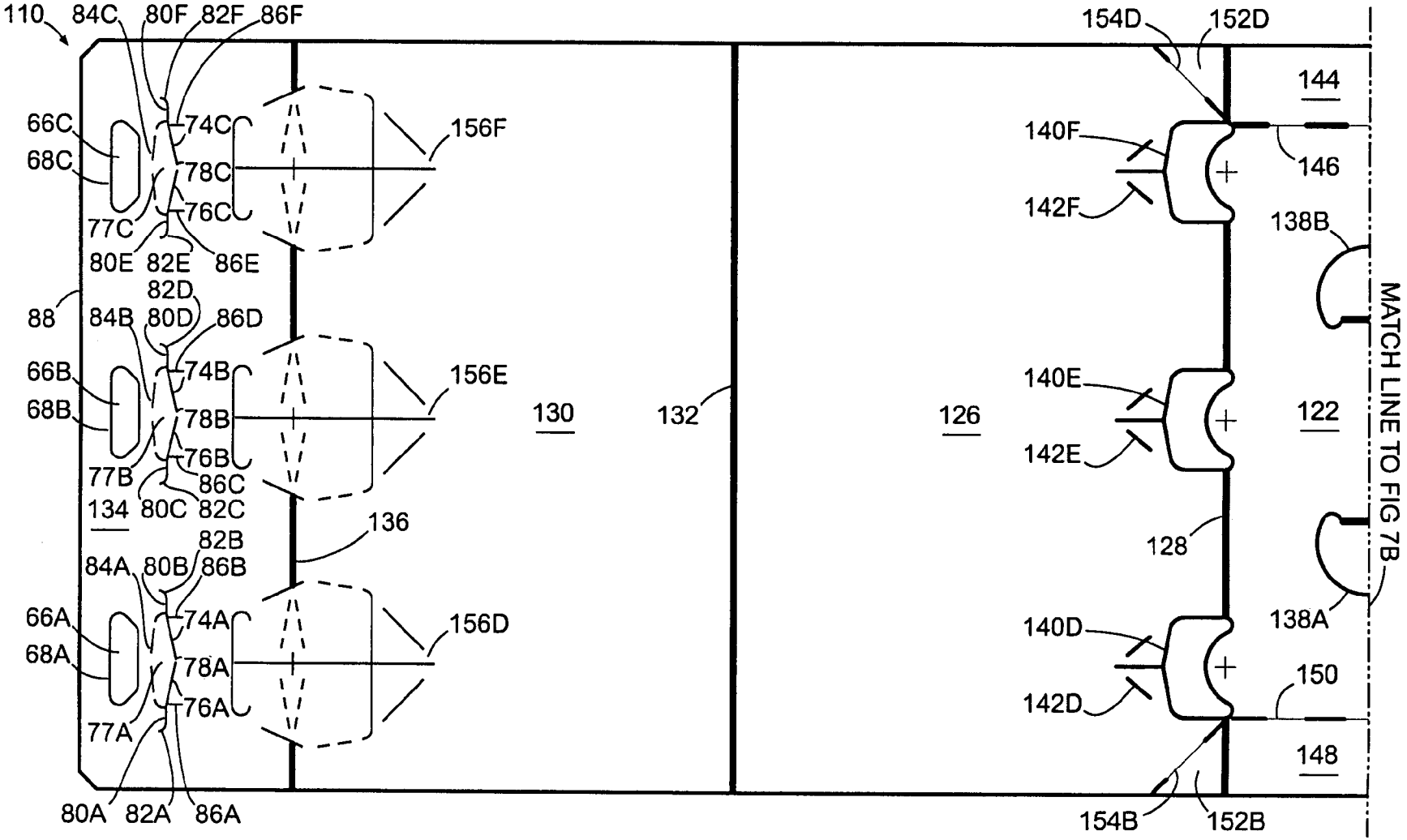
FIG. 7 is a plan view of a carrier blank for forming a carrier to contain six bottles of one embodiment of this invention.
Figure 7B:
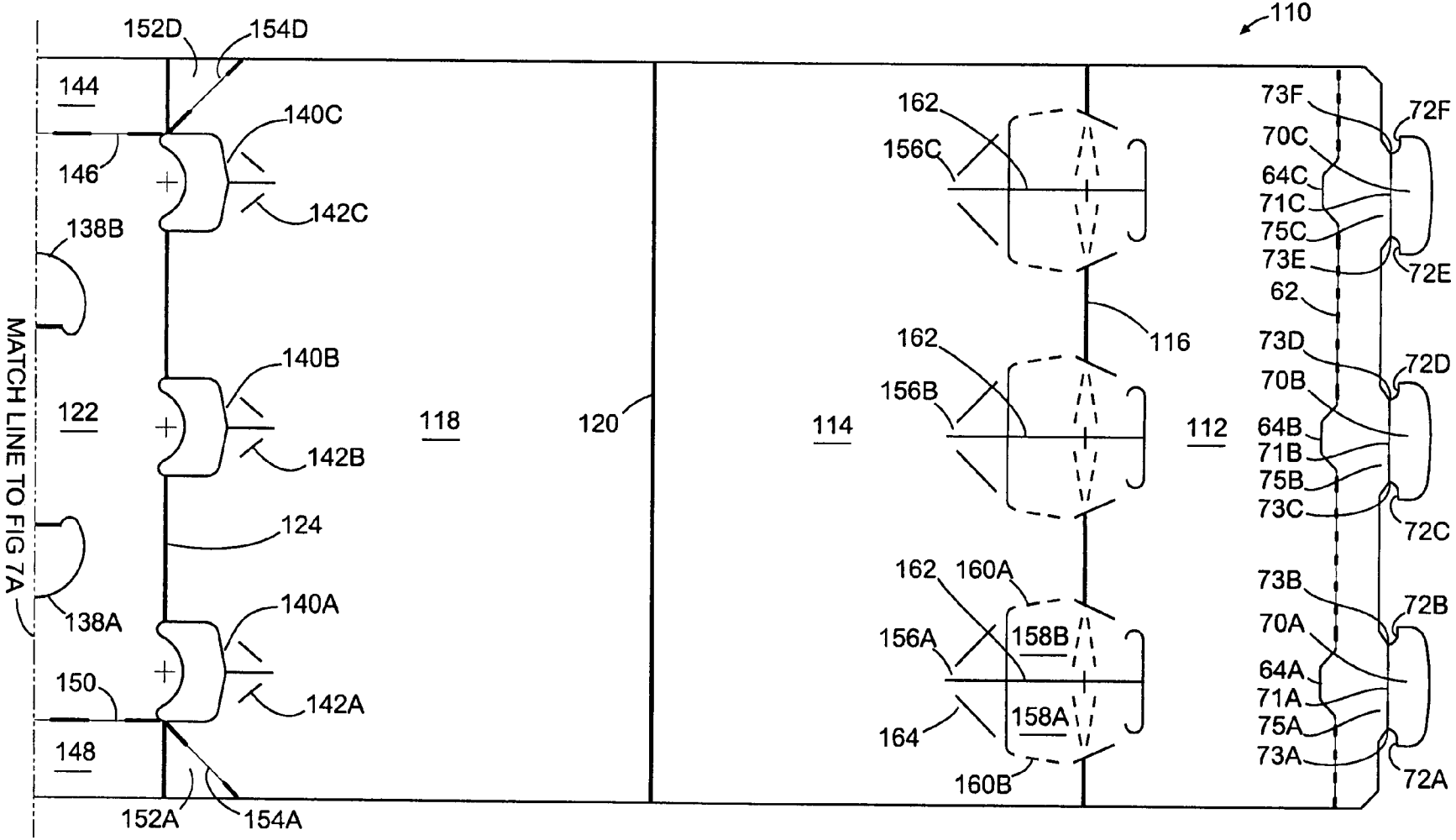
Figure 8:
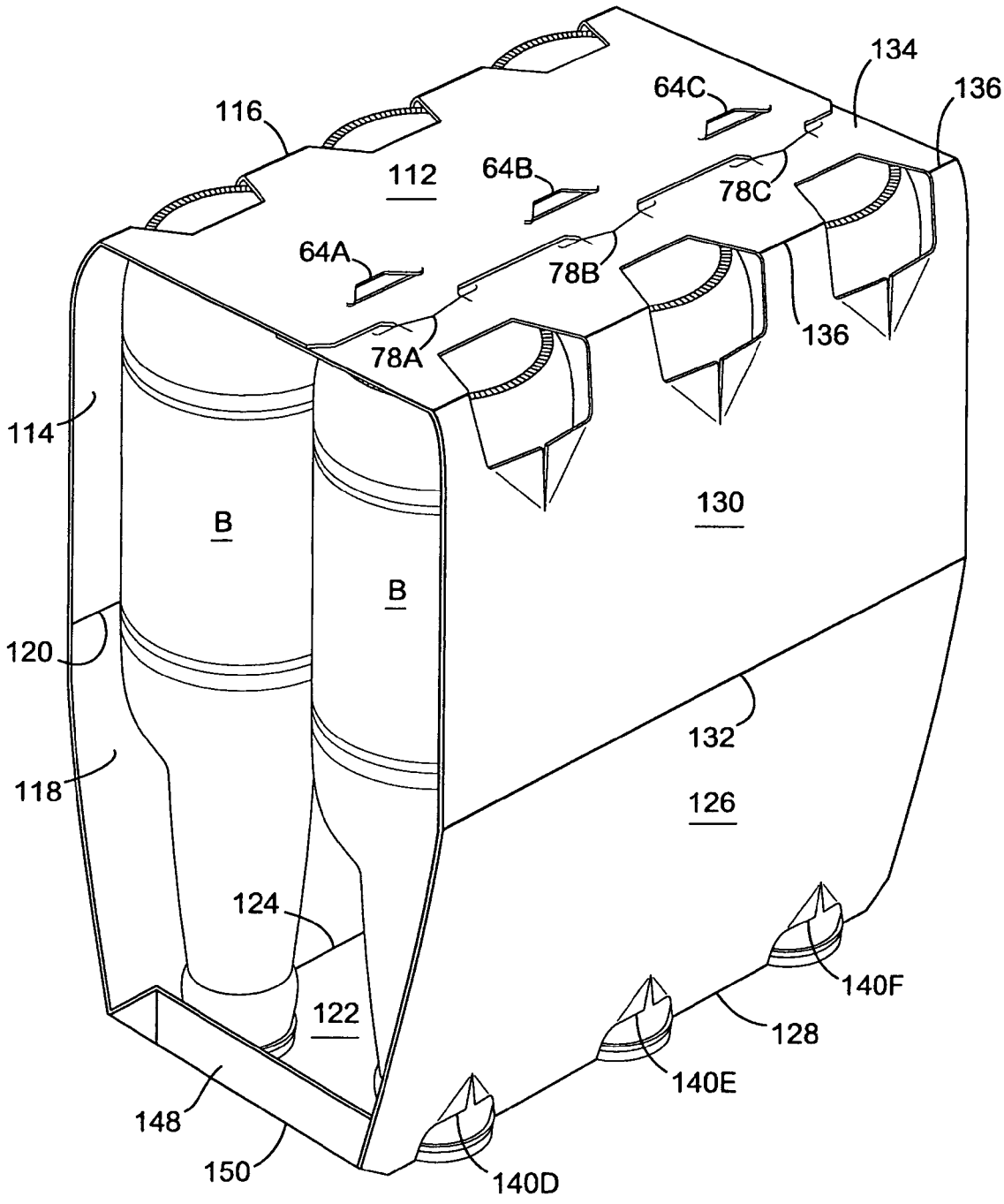
FIG. 8 is a perspective view of a carrier made from the blank of FIG. 7 and wrapped around six bottles with the carrier being shown in the invented position with all of the primary and secondary locks locked.

A blank 110 for forming another embodiment of this invention which is a wrap-around carrier for carrying six bottles in two rows in illustrated in FIG. 7. The carrier made from this blank 110 uses the same primary and secondary locking system as the carrier made from the blank 10 illustrated in FIG. 1. The same sequence of numbers from 62 to 82 is used to refer to the locking system in the blank 110 illustrated in FIG. 7 as are used in FIG. 1.

The blank 110 illustrated in FIG. 7 has an outer flap 112 connected to a lower side panel 114 by fold line 116 and connected to upper side panel 118 by fold line 120 and in turn connected to top panel 122 by fold line 124 and to upper side panel 126 by fold line 128. Upper side panel 126 is connected to lower side panel 130 by fold line 132 and to inner flap 134 by fold line 136.

The carrier made from the blank 110 has finger apertures 138A–B for carrying the loaded carrier. Bottle cap apertures 140A–F are provided for assisting in holding the bottles in the carrier with open ends and also to produce a tighter wrap around the bottles. Expansion slits 142A–F are provided to prevent the tearing of bottle cap apertures 140A–F and to allow the nesting of the bottle caps and necks in the bottle cap apertures 140A–F. End flaps 144 and 148 which are connected to top panel 122 by fold lines 146 and 150 respectively are provided. Gusset panels 152A–D permit the end flaps 144 and 148 to be folded down to assist in holding the bottles in the carrier. Gusset panels 152A–D are attached to upper side panel 118 or upper side panel 126 by fold lines 154A–D.

Heel apertures 156A–F may be provided where the heel of the bottle can be nested to assist in holding the bottles in the carrier and the carrier being tightly wrapped around the group of bottles. Using heel aperture 156A as an example, twin doors 158A–B are provided which are separated by cut 162 and are foldably attached to the blank 110 at longitudinal fold lines 160A, 160B. Expansion slits 164 are provided so the heel of the bottle can nest tightly in a heel aperture 156A without tearing the carrier.

The blank 110 is wrapped around a group of bottles in much the same way as the blank 10 is wrapped around a group of cans. The blank 110 is draped over a group of six bottles in two rows and the upper side panels 118 and 126 and lower side panels 114 and 130 folded downwardly. A portion of the bottle cap and neck of the bottle will project through each bottle cap aperture 140A–F. End flaps 144 and 148 are folded down in into the locked position in which they are held by the gusset panels 152A–F. The doors 158A–B of heel aperture 156A and the doors of the other heel apertures 156B–F are pushed inwardly and the heel of the bottle inserted between the doors into each heel aperture 156A–F. The doors, as illustrated by 158A–B assist in holding the bottle within the heel aperture. The inner flap 134 is folded against the bottom of the bottles with outer flap 112 being folded and overlapping inner flap 134. The primary male locks 64A–C are inserted in primary female apertures 66A–C and engaged with primary lock ledges 68A–C. Secondary male locks 70A–C are inserted through secondary female openings 74A–C so the shoulders 72A–F of the secondary male locks 70A–C engage the secondary locking ledges (see 87E–F in FIG. 5A) formed by extension cuts 80A–F. Both the primary male lock 64A–C and secondary male lock 70A–C lie substantially flat against the inside of the inner flap 134.

The primary locking system and secondary locking system of this invention can be used for wrap-around carriers for cans, bottles and tubs. It may also be used for fully enclosed carriers, such as twelve pack carriers for cans for locking the ends of the carrier. In this case, the ends of the carrier are interlocked with the primary and secondary locking system of this invention.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

Therefore, having thus described the invention, at least the following is claimed:

1. A wrap-around article carrier for carrying a plurality of articles comprising:

(a) a top panel, opposite side panels and a bottom panel comprising an inner flap with a terminal edge and an outer flap with a terminal edge, with a portion of the outer flap overlapping a portion of the inner flap;

(b) the inner flap having at least one primary lock ledge formed by a primary female opening in the inner flap, the outer flap having a primary male lock for each lock ledge which is formed by a slit cut in the outer flap; and (c) the outer flap having at least one secondary male lock with two shoulders attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding the secondary male lock into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap.

2. The wrap-around carrier of claim 1, wherein the extension cut turns and projects towards the terminal edge of the inner flap at a point remote from each end of the fold line.

3. The wrap-around carrier of claim 1, wherein each secondary female opening has a slit that extends for a short distance from the secondary cut line near each end of the fold line in a direction away from the terminal edge of the inner flap.

4. The wrap-around carrier of claim 3, wherein the neck of each secondary male lock has two edges, with the distance between the edges of the neck being less than the distance between the slits, with the neck of the secondary male lock being designed to be located in the secondary female opening between the slits.

5. The wrap-around carrier of claim 1, which has been loaded with articles and each primary male lock is engaged with a lock ledge formed by a primary female opening, and the shoulder of each secondary male lock is engaged with a secondary locking ledge, thereby securing the articles in the carrier.

6. A wrap-around article carrier for carrying a plurality of articles comprising:

(a) a top panel, opposite side panels and a bottom panel comprising an inner flap with a terminal edge and an outer flap with a terminal edge with a portion of the outer flap overlapping a portion of the inner flap;

(b) the inner flap having at least one primary lock ledge formed by a primary female opening in the inner flap, the outer flap having a primary male lock for each lock ledge which is formed by a slit cut in the outer flap; and (c) the outer flap having at least one secondary male lock with two shoulders attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line being arcuate shaped and having a center and two ends with the center being closer to the terminal edge of the inner flap than the ends of the fold line, the secondary cut line meeting the fold line at each end of the fold line, the secondary cut line being shaped for guiding the secondary male lock into a flat position against the inner flap, with the secondary cut line being V shaped with the apex of the V being further from the terminal edge of the inner flap than the rest of the cut line, the secondary cut line and fold line forming a female flap in the secondary female opening, the secondary cut line comprising an extension cut extending beyond each end of the fold line to form a secondary locking ledge along the side of the extension cut remote from the terminal edge of the inner flap.

7. The wrap-around carrier of claim 6, which has been loaded with articles and each primary male lock is engaged with a lock ledge formed by a primary female opening, and the shoulder of each secondary male lock is engaged with a secondary locking ledge, thereby securing the articles in the carrier.

8. The wrap-around carrier of claim 6, wherein the extension cut turns and projects towards the terminal edge of the inner flap at a point remote from each end of the fold line.

9. The wrap-around carrier loaded with a plurality of articles of claim 7, wherein each secondary female opening has a slit that extends for a short distance from the secondary cut line near each end of the fold line in a direction away from the terminal edge of the inner flap.

10. The wrap-around carrier loaded with a plurality of articles of claim 9, wherein the neck of each secondary male lock has two edges, with the distance between the edges of the neck being less than the distance between the slits, with the neck of the secondary male lock being designed to be located in the secondary female opening between the slits.

11. A blank for forming a wrap-around carrier for carrying a plurality of containers comprising:

(a) a top panel, opposite side panels and a bottom panel comprising an inner flap with a terminal edge and an outer flap with a terminal edge;

(b) the inner flap having at least one primary lock ledge formed by a primary female opening in the inner flap, the outer flap having a primary male lock for each lock ledge which is formed by a slit cut in the outer flap; and (c) the outer flap having at least one secondary male lock with two shoulders attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding the secondary male lock into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap.

12. The wrap-around carrier of claim 1, for carrying a plurality of containers in two rows, the carrier having at least two sets of:

(a) a primary male lock and corresponding primary lock ledge; and (b) a secondary male lock and two secondary locking ledges.

13. The wrap-around carrier of claim 6, for carrying a plurality of containers in two rows, the carrier having at least two sets of:

(a) a primary male lock and corresponding primary lock ledge; and (b) a secondary male lock and two secondary locking ledges.

14. The wrap-around carrier of claim 1, for carrying a plurality of containers in at least one row.

15. The wrap-around carrier of claim 6, for carrying a plurality of containers in at least one row.

16. A wrap-around carrier loaded with a plurality of containers in two rows, the carrier comprising:

(a) a top panel, opposite side panels and a bottom panel comprising an inner flap with a terminal edge and an outer flap with a terminal edge, with a portion of the outer flap overlapping a portion of the inner flap;

(b) the inner flap having at least two primary lock ledges, with each ledge formed by a primary female opening in the inner flap, the outer flap having a primary male lock for each lock ledge which is formed by a slit cut in the outer flap, with each primary male lock being engaged with a primary locking ledge, with each primary male lock being at least substantially flat against the inner flap; and (c) the outer flap having at least two secondary male locks, with each secondary male lock attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding one of the at least two secondary male locks into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap, with each secondary male lock extending through a secondary female opening with each shoulder of each secondary male lock engaging a secondary locking ledge, with each secondary male lock being at least substantially flat against the inner flap of the carrier.

17. The wrap-around carrier loaded with a plurality of containers in two rows of claim 16, wherein the extension cut turns and projects towards the terminal edge of the inner flap at a point remote from each end of the fold line.

18. The wrap-around carrier loaded with a plurality of containers in two rows of claim 16, wherein each secondary female opening has a pair of slits that extend for a short distance from the secondary cut line near each end of the fold line in a direction away from the terminal edge of the inner flap.

19. The wrap-around carrier loaded with containers of two rows of claim 18, wherein the neck of each secondary male lock has two edges, with the distance between the edges of the neck being less than the distance between the slits, with the neck of the secondary male lock being designed to be located in the secondary female opening between the slits.

20. The wrap-around carrier of claim 16, wherein the containers are either bottles or cans.

21. A wrap-around carrier loaded with a plurality of containers in one row, the carrier comprising:

(a) a top panel, opposite side panels and a bottom panel comprising an inner flap with a terminal edge and an outer flap with a terminal edge with a portion of the outer flap overlapping a portion of the inner flap;

(b) the inner flap having at least two primary lock ledges, with each ledge formed by a primary female opening in the inner flap, the outer flap having a primary male lock for each lock ledge which is formed by a slit cut in the outer flap, with each primary male lock being engaged with a primary locking ledge, with each primary male lock being at least substantially flat against the inner flap; and (c) the outer flap having at least two secondary male locks, with each secondary male lock attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding one of the at least two secondary male locks into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap, with each secondary male lock extending through a secondary female opening with each shoulder of each secondary male lock engaging a secondary locking ledge, with each secondary male lock being at least substantially flat against the inner flap of the carrier.

22. The wrap-around carrier loaded with a plurality of containers in one row of claim 21, wherein the extension cut turns and projects towards the terminal edge of the inner flap at a point remote from each end of the fold line.

23. The wrap-around carrier loaded with a plurality of containers in one row of claim 21, wherein a pair of slits that extend for a short distance from the secondary cut line near each end of the fold line in a direction away from the terminal edge of the inner flap.

24. A wrap-around carrier loaded with at least four containers in two rows, the carrier comprising:

(a) a top panel, opposite side panels and a bottom panel comprising an inner flap with a terminal edge and an outer flap with a terminal edge, with a portion of the outer flap overlapping a portion of the inner flap;

(b) the inner flap having at least two primary locking ledges, with each ledge formed by a primary female opening in the inner flap, the outer flap having a primary male lock for each lock ledge which is formed by a slit cut in the outer flap with each primary lock being engaged with a primary locking ledge, with each primary male lock being at least substantially flat against the inner flap; and (c) the outer flap having at least two secondary male locks with each secondary male lock attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding one of the at least two secondary male locks into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap, with each secondary male lock extending through a secondary female opening with each shoulder of each secondary male lock engaging a secondary locking ledge, with each secondary male lock being at least substantially flat against the inner flap of the carrier.

25. The wrap-around carrier loaded with at least four containers in two rows of claim 24, wherein the extension cut turns and projects towards the terminal edge of the inner flap at a point remote from each end of the fold line.

26. The wrap-around carrier loaded with at least four bottles in two rows of claim 24, wherein a pair of slits that extend for a short distance from the secondary cut line near each end of the fold line in a direction away from the terminal edge of the inner flap.

27. An interlocking panel in an article carrier, the interlocking panel being connected to opposite side panels of the carrier, the interlocking panel comprising:

(a) inner and outer flaps which are connected to the side panels of the carrier, the inner and outer flaps each having a terminal edge, with a portion of the outer flap overlapping a portion of the inner flap;

(b) the inner flap having at least one primary lock ledge formed by a primary female opening in the inner flap, the outer flap having a primary male lock for each lock ledge which is formed by a slit cut in the outer flap; and (c) the outer flap having at least one secondary male lock with two shoulders attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding the secondary male lock into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap.

28. The interlocking panel of claim 27, wherein the extension cut turns and projects towards the terminal edge of the inner flap at a point remote from each end of the fold line.

29. The interlocking panel of claim 27, wherein a pair of slits that extend for a short distance from the secondary cut line near each end of the fold line in a direction away from the terminal edge of the inner flap.

30. The interlocking panel of claim 27, wherein the carrier has been loaded with articles and each primary male lock is engaged with a lock ledge formed by a primary female opening, and the shoulder of each secondary male lock is engaged with a secondary locking ledge, thereby securing the inner and outer flaps together as an interlocking panel.

31. An interlocking panel in an article carrier, the interlocking panel being connected to opposite side panels of the carrier, the interlocking panel comprising:

(a) inner and outer flaps which are connected to the side panels of the carrier, the inner and outer flaps each having a terminal edge, with a portion of the outer flap overlapping a portion of the inner flap;

(b) the inner flap having at least one primary lock ledge formed by a primary female opening in the inner flap, the outer flap having a primary male lock for each lock ledge which is formed by a slit cut in the outer flap; and (c) the outer flap having at least one secondary male lock with two shoulders attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line being arcuate shaped and having a center and two ends with the center being closer to the terminal edge of the inner flap than the ends of the fold line, the secondary cut line meeting the fold line at each end of the fold line, the secondary cut line being shaped for guiding the secondary male lock into a flat position against the inner flap, and being V shaped with the apex of the V being further from the terminal edge of the inner flap than the rest of the cut line, the secondary cut line and fold line forming a female flap in the secondary female opening, the secondary cut line comprising an extension cut extending beyond each end of the fold line to form a secondary locking ledge along the side of the extension cut remote from the terminal edge of the inner flap.

32. The interlocking panel of claim 31, wherein the extension cut turns and projects towards the terminal edge of the inner flap at a point remote from each end of the fold line.

33. The interlocking panel of claim 31, wherein a pair of slits that extend for a short distance from the secondary cut line near each end of the fold line in a direction away from the terminal edge of the inner flap.

34. An interlocking panel in an article carrier, the interlocking panel being connected to opposite side panels of the carrier, the interlocking panel comprising:

(a) inner and outer flaps which are connected to the side panels of the carrier, the inner and outer flaps each having a terminal edge;

(b) the inner flap having at least two primary lock ledges, with each ledge formed by a primary female opening in the inner flap, the outer flap having a primary male lock for each lock ledge which is formed by a slit cut in the outer flap, with each primary male lock being engaged with a primary lock ledge, with each primary male lock being at least substantially flat against the inner flap; and (c) the outer flap having at least two secondary male locks, with each secondary male lock attached by a neck to the terminal edge of the flap, and the inner flap having a secondary female opening for each secondary male lock, the secondary female opening being further from the terminal edge of the inner flap than the primary female opening, with each secondary female opening formed by a secondary cut line and fold line which is closer to the terminal edge of the inner flap than the cut line, the fold line having a center and two ends with the secondary cut line at least nearly meeting the fold line at each end of the fold line, the secondary cut line being shaped for guiding one of the at least two secondary male locks into a flat position against the inner flap, with the secondary cut line having a center that is significantly further from the terminal edge of the inner flap than the rest of the cut line, the secondary cut line and fold line forming a female flap in the secondary female opening with the fold line projecting towards the terminal edge of the inner flap from the ends of the fold line to the center, the secondary cut line comprising an extension cut extending beyond each end of the fold line to form a secondary locking ledge along the side of the extension cut remote from the terminal edge of the inner flap, with each secondary male lock extending through a secondary female opening with each shoulder of each secondary male lock engaging a secondary locking ledge, with each secondary male lock being at least substantially flat against the inner flap of the carrier.

35. The interlocking panel of claim 34, wherein the extension cut turns and projects towards the terminal edge of the inner flap at a point remote from each end of the fold line.

36. The interlocking panel of claim 34, wherein a pair of slits that extend for a short distance from the secondary cut line near each end of the fold line in a direction away from the terminal edge of the inner flap.

37. The wrap-around carrier of claim 24, wherein the containers are either bottles or cans.

38. The wrap-around carrier of claim 3 wherein the slit includes a pair of slits.

39. The wrap-around carrier of claim 38 wherein the neck has a width and the pair of slits are spaced apart a distance greater than the width of the neck.

* * * * *